US009161148B2

(12) United States Patent
Lee et al.

(10) Patent No.: US 9,161,148 B2
(45) Date of Patent: Oct. 13, 2015

(54) SIGNAL PROCESSING APPARATUS AND METHOD FOR PROVIDING 3D SOUND EFFECT

(75) Inventors: Kang Eun Lee, Hwaseong-si (KR); Do-Hyung Kim, Hwaseong-si (KR); Shi Hwa Lee, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 666 days.

(21) Appl. No.: 13/432,581

(22) Filed: Mar. 28, 2012

(65) Prior Publication Data

US 2013/0064374 A1 Mar. 14, 2013

(30) Foreign Application Priority Data

Sep. 9, 2011 (KR) ..... 10-2011-0091865

(51) Int. Cl.
*H04R 5/00* (2006.01)
*H04S 3/00* (2006.01)
*H04S 3/02* (2006.01)

(52) U.S. Cl.
CPC .. *H04S 3/004* (2013.01); *H04S 3/02* (2013.01)

(58) Field of Classification Search
CPC ..... H04R 5/00; H04R 3/02; H04S 1/00; H04S 7/00; H04S 5/02; H04S 1/002; H04S 2420/01; H04S 5/00; H04S 2420/03; H04B 1/00; G10K 15/00; G10L 21/02; G10L 19/00; G10L 21/00; H03G 3/00; H03G 5/00; G06F 17/00
USPC ..... 381/1, 17, 18, 61, 22, 23, 20, 27, 80, 381/98, 99, 100, 101, 102, 103, 307, 119, 381/97; 704/500, E21.001, 216, 224, 226; 700/94
See application file for complete search history.

(56) References Cited

U.S. PATENT DOCUMENTS

| | | | | |
|---|---|---|---|---|
| 2008/0226085 | A1 | 9/2008 | Takashima | |
| 2009/0092259 | A1 * | 4/2009 | Jot et al. | 381/17 |
| 2009/0198356 | A1 * | 8/2009 | Goodwin et al. | 700/94 |

FOREIGN PATENT DOCUMENTS

| | | |
|---|---|---|
| JP | 7-99700 | 4/1995 |
| JP | 2006-303799 | 11/2006 |
| JP | 2007-88568 | 4/2007 |
| JP | 2007-228033 | 9/2007 |
| JP | 2007-336118 | 12/2007 |
| JP | 2008-92411 | 4/2008 |
| JP | 2011-23862 | 2/2011 |
| KR | 10-2005-0075029 | 7/2005 |
| KR | 10-2007-0047700 | 5/2007 |
| KR | 10-2007-0053305 | 5/2007 |
| KR | 10-2010-0034004 | 3/2010 |
| KR | 10-2010-0065372 | 6/2010 |
| KR | 10-2011-0063003 | 6/2011 |

OTHER PUBLICATIONS

"Ambience Extraction and Synthesis From Stereo Signals for Multi-Channel Audio Up-mix", IEEE conference publications, vol. II, 1109/ICASSP, year 2002, p. 1957-1960.*

* cited by examiner

*Primary Examiner* — Leshui Zhang
(74) *Attorney, Agent, or Firm* — Staas & Halsey LLP

(57) ABSTRACT

A signal processing apparatus and method providing a 3-dimensional (3D) sound effect may determine a mask related to an ambience of an input signal, separate the input signal into a primary signal and an ambience signal using the mask, decorrelate the ambience signal, and sum the decorrelated ambience signal and the primary signal, accordingly generating an output signal to which a sound effect is applied.

18 Claims, 10 Drawing Sheets

SIGNAL PROCESSING APPARATUS AND METHOD FOR PROVIDING 3D SOUND EFFECT

CROSS-REFERENCE TO RELATED APPLICATIONS

This application claims the priority benefit of Korean Patent Application No. 10-2011-0091865, filed on Sep. 9, 2011, in the Korean Intellectual Property Office, the disclosure of which is incorporated herein by reference.

BACKGROUND

1. Field

Example embodiments of the following description relate to a signal processing apparatus and method, and more particularly, to a signal processing apparatus and method for providing a 3-dimensional (3D) sound effect by separating an input signal into a primary signal and an ambience signal.

2. Description of the Related Art

In order to apply a 3-dimensional (3D) sound effect to an audio signal, an ambience signal that corresponds to a background signal and noise needs to be extracted from an input signal. Conventionally, the ambience signal to be extracted from the input signal is determined by a coherence value of a predetermined section. In a physical sense, the coherence value refers to a statistical value of interference between two signals in the predetermined section.

Extraction of the ambience signal based on the coherence of the predetermined section may be efficient in a relatively simple signal. However, in a variable signal, it is difficult to quickly determine similarity. Therefore, noise may be mixed into a separated primary signal, or separation of the ambience signal and the primary signal may not be performed accurately.

Furthermore, when the coherence is extracted according to a conventional method, a phase difference between a left signal and a right signal of the input signal may not be reflected correctly. According to conventional art, since the coherence always has a value greater than or equal to 0 and less than or equal to a positive value of 1, although the phase of the left signal is 1+j and the phase of the right signal is −1−j, that is, opposite to the left signal, the coherence becomes 1. That is, the phase difference between the left signal and the right signal may not be properly reflected.

Accordingly, there is a demand for a method of reflecting a phase difference of an input signal while quickly extracting an ambience signal, even from a variable signal.

SUMMARY

The foregoing and/or other aspects are achieved by providing a signal processing apparatus including a mask determination unit to determine a mask related to an ambience of an input signal, a signal separation unit to separate the input signal into a primary signal and an ambience signal using the mask, a decorrelation unit to de-correlate the ambience signal, and a signal generation unit to generate an output signal to which a sound effect is applied, by summing the decorrelated ambience signal and the primary signal.

The foregoing and/or other aspects are also achieved by providing a signal processing apparatus including a signal separation unit to separate a stereo signal into a primary signal and an ambience signal based on an ambience of the stereo signal, a decorrelation unit to decorrelate the ambience signal, and a signal generation unit to generate an output signal to which a sound effect is applied, by summing the decorrelated ambience signal and the primary signal.

The foregoing and/or other aspects are achieved by providing a signal processing method including determining a mask related to an ambience of an input signal, separating the input signal into a primary signal and an ambience signal using the mask, decorrelating the ambience signal, and generating an output signal to which a sound effect is applied, by summing the decorrelated ambience signal and the primary signal.

The foregoing and/or other aspects are also achieved by providing a signal processing method including separating a stereo signal into a primary signal and an ambience signal based on an ambience of the stereo signal, decorrelating the ambience signal, and generating an output signal to which a sound effect is applied, by summing the decorrelated ambience signal and the primary signal.

Additional aspects, features, and/or advantages of example embodiments will be set forth in part in the description which follows and, in part, will be apparent from the description, or may be learned by practice of the disclosure.

According to example embodiments, a mask denoting an ambience is applied to an input signal in units of frames so that similarity is determined quickly. Therefore, a primary signal and an ambience signal may be quickly separated from an input signal.

According to example embodiments, when extracting the mask related to the ambience, similarity between a left signal and a right signal, which denotes the ambience, is expressed by a value between −1 and 1. Therefore, a phase difference between the left signal and the right signal may be reflected.

BRIEF DESCRIPTION OF THE DRAWINGS

These and/or other aspects and advantages will become apparent and more readily appreciated from the following description of the example embodiments, taken in conjunction with the accompanying drawings of which.

DETAILED DESCRIPTION

Figure 1:
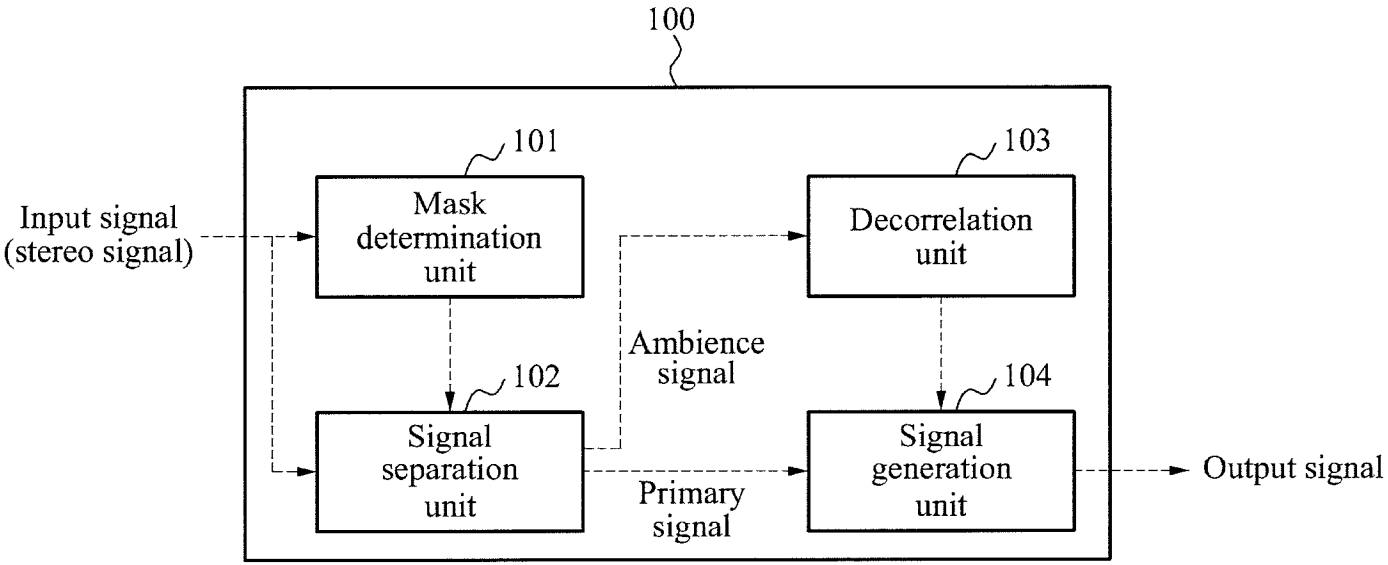
FIG. 1 illustrates a signal processing apparatus according to example embodiments.

Reference will now be made in detail to example embodiments, examples of which are illustrated in the accompanying drawings, wherein like reference numerals refer to like elements throughout. Example embodiments are described below to explain the present disclosure by referring to the figures.

FIG. 1 illustrates a signal processing apparatus according to example embodiments.

Referring to FIG. 1, a signal processing apparatus 100 includes a mask determination unit 101, a signal separation unit 102, a decorrelation unit 103, and a signal generation unit 104.

The mask determination unit 101 may determine a mask related to an ambience of an input signal. The ambiance may refer to a background signal or noise of the input signal. Here, the mask may be determined in units of frames. Hereinafter, a description will be provided under the presumption that the input signal is a stereo signal. However, it should be understood that example embodiments are not limited to such a case.

For example, the mask determination unit 101 may determine a time-frequency grid with respect to the input signal converted from a time domain to a frequency domain. Additionally, the mask determination unit 101 may determine the mask expressed by a level corresponding to the ambience related to respective frequency bins on the time-frequency grid. That is, the mask determination unit 101 may perform a soft decision with respect to the ambience of the input signal, by expressing the ambience by various levels, rather than by only on and off states.

The ambience refers to similarity between a left signal and a right signal of the input signal. More specifically, the mask determination unit 101 may calculate the similarity between the left signal and the right signal based on an influence of the left signal with respect to the right signal and an influence of the right signal with respect to the left signal, and then determine the mask using the calculated similarity.

In addition, the mask determination unit 101 may apply non-linear mapping to the mask representing the ambience. More particularly, the mask determination unit 101 may flexibly adjust the strength of the mask, by restricting a maximum and a minimum of the ambience included in the mask through the non-linear mapping.

Also, the mask determination unit 101 may apply temporal smoothing to the mask. In this instance, when the mask is abruptly changed between frames, a transition may occur. In this case, the mask determination unit 101 may apply the temporal smoothing to reduce noise caused due to the transition.

The signal separation unit 102 may separate the input signal into a primary signal and an ambience signal using the mask.

The decorrelation unit 103 may decorrelate the ambience signal. The ambience signal refers to a signal having a relatively low similarity between the left signal and the right signal. Therefore, when the primary signal is partially reflected to the ambience signal, the similarity may increase. Accordingly, the decorrelation unit 103 may decrease the similarity of the ambience signal by removing correlation between the left signal and the right signal of the ambience signal extracted by applying the mask.

The signal generation unit 104 may generate an output signal to which a sound effect is applied, by summing the decorrelated ambience signal and the primary signal. For example, the signal generation unit 104 may extract a multichannel signal by applying the ambience signal to a feedback delay network. Next, the signal generation unit 104 may perform channel decomposition by applying a delay to the multichannel signal.

Figure 2:
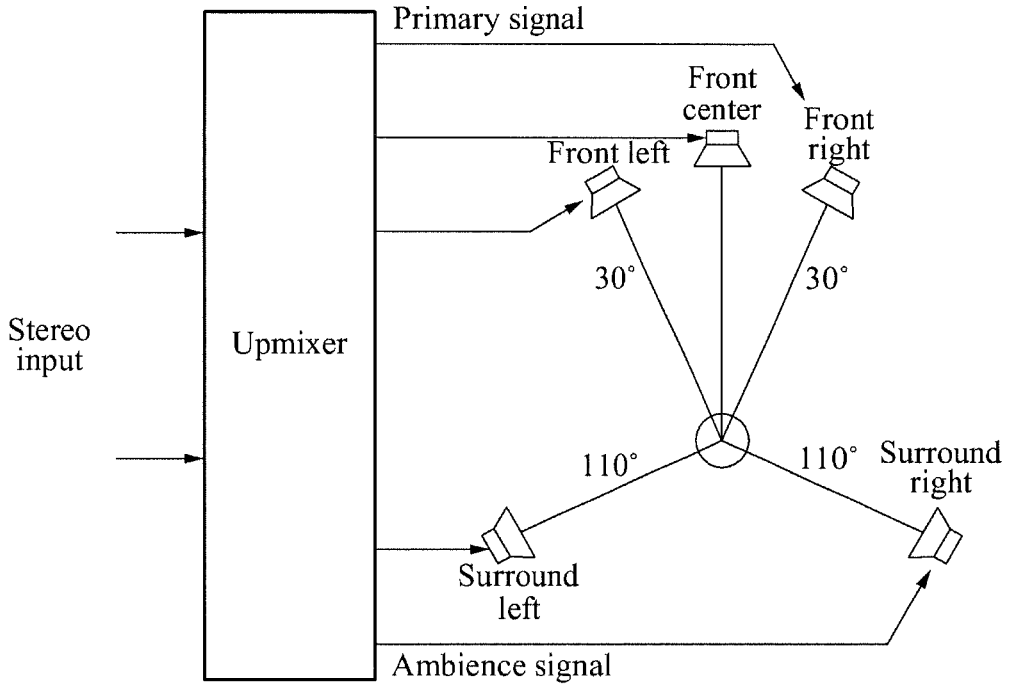
FIG. 2 illustrates application of a 3-dimensional (3D) sound effect to an input signal according to example embodiments.

FIG. 2 illustrates application of a 3-dimensional (3D) sound effect to an input signal according to example embodiments.

Referring to FIG. 2, a stereo signal including a left signal and a right signal may be separated into a primary signal and an ambience signal by an up-mixer. That is, through up-mixing, the stereo signal may be output as an audio signal including 5 channels. The 3D sound effect may be applied to the output audio signal through expansion of spatial impression.

Here, the primary signal from which a background signal or noise is removed is allocated to a front speaker in a 5.1-channel surround sound speaker structure. The ambience signal corresponding to the background signal and the noise may be allocated to a surround sound speaker.

Figure 3:
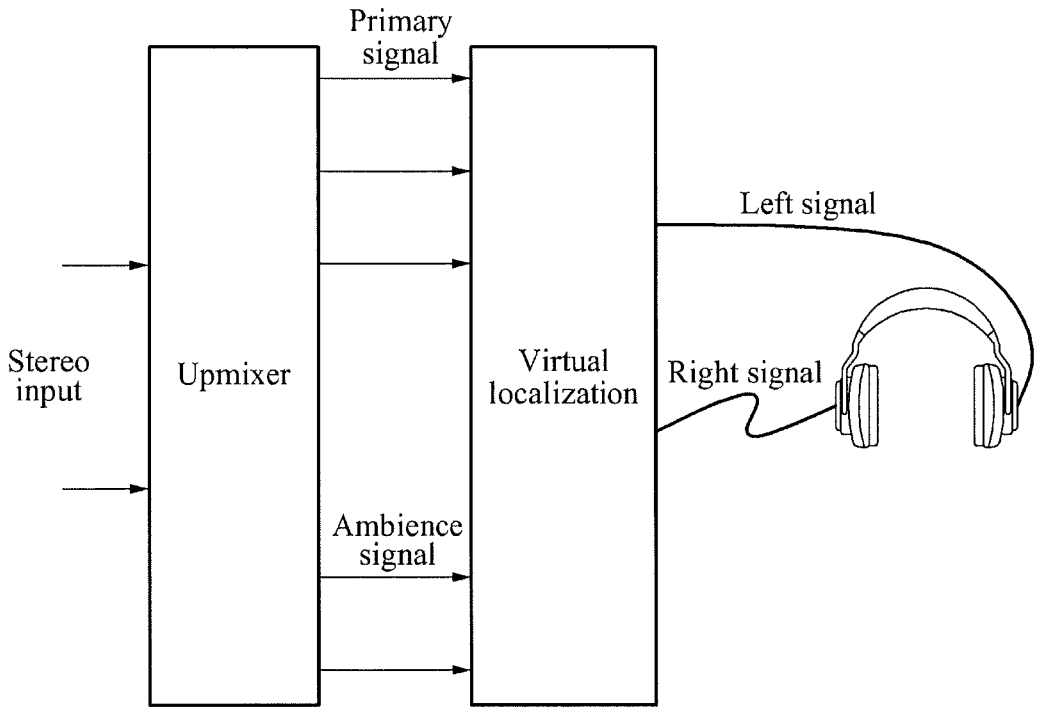
FIG. 3 illustrates application of a 3D sound effect to an input signal according to other example embodiments.

FIG. 3 illustrates application of a 3D sound effect to an input signal according to other example embodiments.

Referring to FIG. 3, a stereo signal including a left signal and a right signal may be separated into a primary signal and an ambience signal by an up-mixer. Since a large reproducing device is not applicable to a mobile apparatus, the mobile apparatus may apply virtual space mapping to provide a 3D sound effect through a headset or an earphone.

Figure 4:
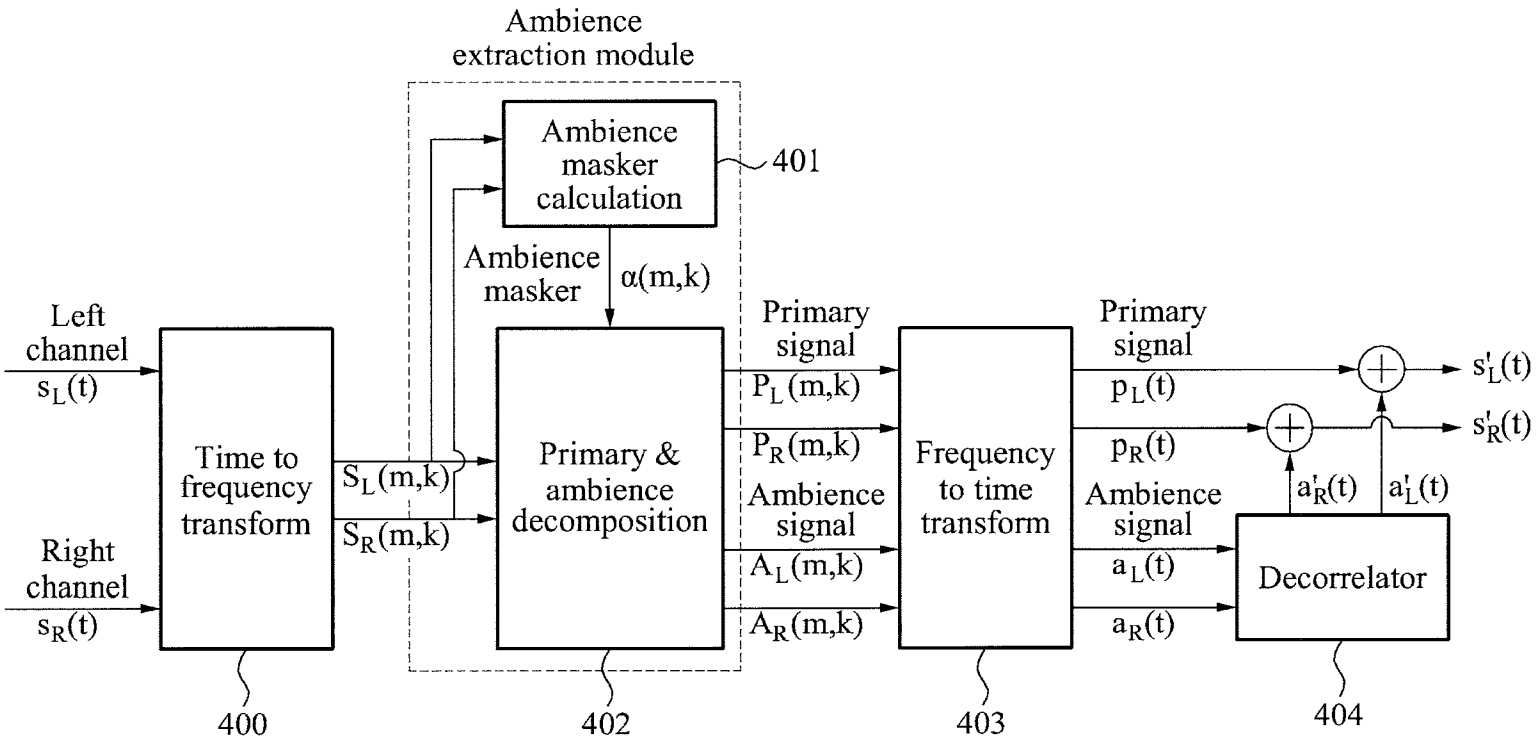
FIG. 4 illustrates a signal processing apparatus that applies a 3D sound effect to an input signal, according to example embodiments.

FIG. 4 illustrates a signal processing apparatus that applies a 3D sound effect to an input signal, according to example embodiments.

Referring to FIG. 4, a left signal $s_L(t)$ and a right signal $s_R(t)$ constituting a stereo signal may be converted from a time domain to a frequency domain through a module 400. Therefore, the left signal $s_L(t)$ and the right signal $s_R(t)$ may be frequency-converted to a left signal $S_L(m,k)$ and a right signal $S_R(m,k)$, respectively. Here, the frequency conversion may be performed in units of frames. In this example, m denotes a frame index and k denotes a frequency index.

The left signal $S_L(m,k)$ and the right signal $S_R(m,k)$ being frequency-converted may be input to a module 401 and input to a module 402. The module 401 may determine a mask $\alpha(m,k)$ related to an ambience using the left signal $S_L(m,k)$ and the right signal $S_R(m,k)$.

The mask $\alpha(m,k)$ related to the ambience may be input to the module 402. The module 402 may output a left signal $P_L(m,k)$ and a right signal $P_R(m,k)$ which are primary signals, from the left signal $S_L(m,k)$ and the right signal $S_R(m,k)$ using the mask $\alpha(m,k)$.

According to the example embodiments, the mask representing the ambience is applied to the input signal by quickly determining similarity in units of frames. Accordingly, separation of the primary signal and the ambience signal from the input signal may be achieved quickly.

Next, the left signal $P_L(m,k)$ and the right signal $P_R(m,k)$ which are the primary signals and a left signal $A_L(m,k)$ and a right signal $A_R(m,k)$ which are the ambience signals may be input to a module 403 and converted from the frequency domain to the time domain, respectively. Therefore, a left signal $p_L(t)$ and a right signal $p_R(t)$, primary signals converted to the time domain, are output through the module 403.

Additionally, a left signal $a_L(t)$ and a right signal $a_R(t)$, the ambience signals, may be input to a module 404. A module 404 may remove correlation from the left signal $a_L(t)$ and the right signal $a_R(t)$, respectively. As a result, a left signal $a'_L(t)$ and a right signal $a'_R(t)$ with a reduced correlation may be output.

Next, the left signal $p_L(t)$ and the right signal $p_R(t)$, which are the primary signals, are summed with the left signal $a'_L(t)$ and the right signal $a'_R(t)$ with the reduced correlation, respectively, thereby outputting a left signal $s'_L(t)$ and a right signal $s'_R(t)$ as final output signals.

Figure 5:
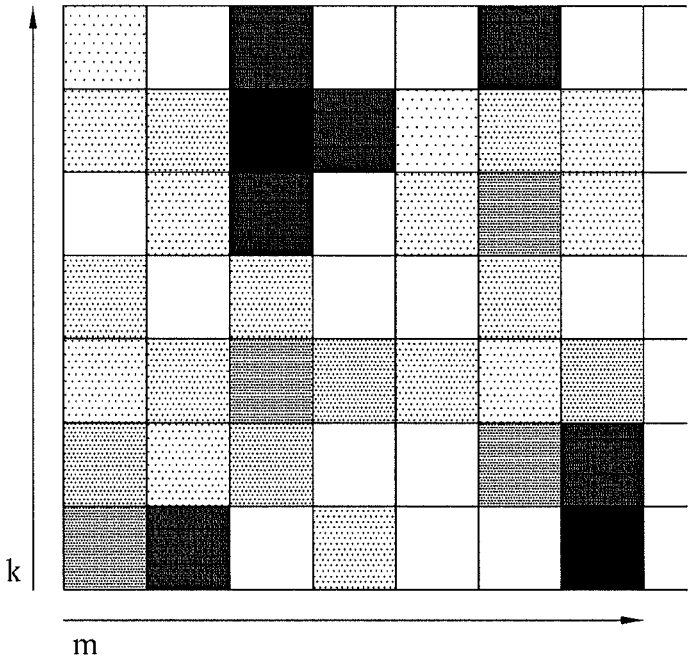
FIG. 5 illustrates a mask related to an input signal, according to example embodiments.

FIG. 5 illustrates a mask related to an input signal, according to example embodiments.

The input signal may be converted from the time domain to the frequency domain according to a unit frame including predetermined samples. In FIG. 5, m denotes a frame index and k denotes a frequency index.

When determining whether the input signal is an ambience signal through a hard decision that determines on and off states, noise may occur in a primary signal and an ambience signal extracted from the input signal. Therefore, in the example embodiments, whether the input signal is the ambience signal may be determined through a soft decision that determines levels corresponding to strength of the ambience.

The mask shown in FIG. 5 may be expressed by levels according to the ambience of respective frequency bins on a time-frequency (T-F) grid. The levels may be distinguished by colors as shown in FIG. 5. According to an example of FIG. 5, the frequency bin has a greater strength of the ambience as the color is darker and a lower strength of the ambience as the color is lighter.

For example, the ambience of each frequency bin may be determined by similarity between a left signal and a right signal using Equation 1.

$$\Phi(m,k)=\frac{S_L(m,k)S_R^*(m,k)+S_L^*(m,k)S_R(m,k)}{2\sqrt{S_L(m,k)S_L^*(m,k)S_R(m,k)S_R^*(m,k)}} \quad \text{[Equation 1]}$$

In Equation 1, $S_L(m,k)S^*_R(m,k)$ refers to an influence of the left signal $S_L(m,k)$ with respect to the right signal $S_R(m,k)$, and $S^*_L(m,k)\,S_R(m,k)$ refers to an influence of the right signal $S_R(m,k)$ with respect to the left signal $S_L(m,k)$. Influence values of both channels with respect to each other are summed and averaged. Thus, an obtained value is normalized through being divided by sqrt($S_L(m,k)\,S^*(m,k)\,S_R(m,k)\,S^*_R(m,k)$).

Accordingly, the similarity calculated in Equation 1 may have a value greater than or equal to −1 and less than or equal to 1 by the Cauchy-Schwarz inequality. Therefore, when the similarity between the left signal and the right signal is relatively great, Equation 1 is approximated to 1. When the similarity is small, Equation 1 is approximated to 0. When phases of the left signal and the right signal are opposite to one another, the similarity is approximated to −1.

According to example embodiments, when a mask related to an ambience is extracted, similarity between a left signal and a right signal, representing the ambience, is expressed by a value between −1 and 1. Therefore, a phase difference between the left signal and the right signal may be reflected.

In the ambience signal separated from the input signal, presuming that the similarity between the left signal and the right signal is decreased, or that phases of the left signal and the right signal are opposite to each other, the mask may be determined using Equation 2.

$$\alpha(m,k)=(1-\Phi(m,k))\gamma \quad \text{[Equation 2]}$$

The mask deduced by Equation 2 is determined to have a higher value as the similarity determined by Equation 1 decreases.

In Equation 2, γ adjusts strength of the mask. Specifically, the strength of the mask is increased as γ is higher and decreased as γ is lower.

In addition, the mask may be changed through non-linear mapping. Specifically, a maximum and a minimum of the mask are defined through the non-linear mapping so that the strength of the mask may be flexibly adjusted. The non-linear mapping may be performed using Equation 3.

$$\tilde{\alpha}=\frac{\mu_1-\mu_0}{2}\tanh\{\sigma\pi(\alpha-\alpha_0)\}+\frac{\mu_1+\mu_0}{2} \quad \text{[Equation 3]}$$

Here, $\mu_0$ and $\mu_1$ denote coefficients for expressing the minimum and the maximum of the non-linear mapped mask. $\alpha_0$ denotes a shifting degree of the non-linear mapping and σ denotes a gradient of the non-linear mapping.

The mask is determined in units of frames. Here, when the mask determined in units of frame is abruptly changed, a result deduced through the mask may be affected by noise due to a transition.

To reduce noise, temporal smoothing may be applied to the mask. The temporal smoothing may be applied using Equation 4.

$$\hat{\alpha}(m,k)=\lambda\tilde{\alpha}(m-1,k)+(1-\lambda)\tilde{\alpha}(m,k) \quad \text{[Equation 4]}$$

Figure 6:
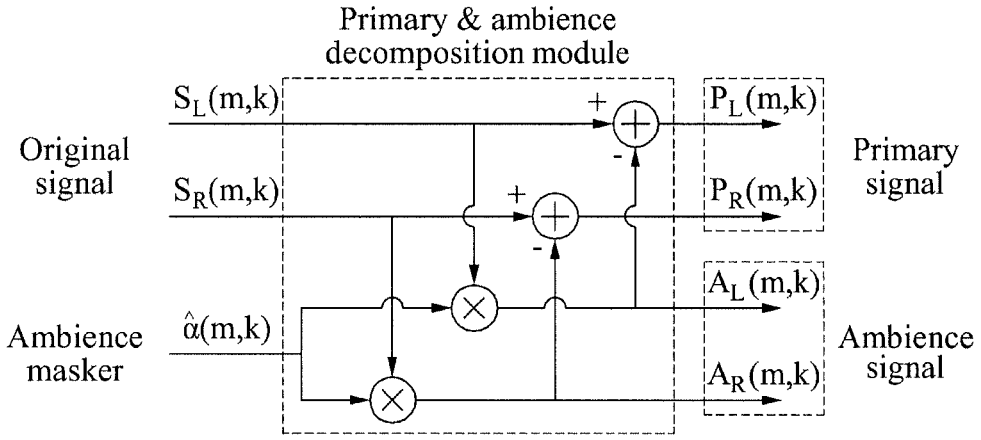
FIG. 6 illustrates a process of extracting a primary signal and an ambience signal by applying a mask, according to example embodiments.

FIG. 6 illustrates a process of extracting a primary signal and an ambience signal by applying a mask, according to example embodiments.

A signal processing apparatus according to the example embodiments may apply the mask $\hat{\alpha}(m,k)$ deduced from Equation 4 to the left signal $S_L(m,k)$ and the right signal $S_R(m,k)$, which, according to Equation 5, are the input signals. Therefore, the left signal $A_L(m,k)$ and the right signal $A_R(m,k)$, the ambience signals, may be deduced.

$$A_L(m,k)=\hat{\alpha}(m,k)S_L(m,k)$$

$$A_R(m,k)=\hat{\alpha}(m,k)S_R(m,k) \quad \text{[Equation 5]}$$

In addition, the signal processing apparatus may subtract the left signal $A_L(m,k)$ and the right signal $A_R(m,k)$, which are the ambience signals, from the left signal $S_L(m,k)$ and the right signal $S_R(m,k)$, which are the input signals, thereby outputting the left signal $P_L(m,k)$ and the right signal $P_R(m,k)$, which are the primary signals. The primary signals and the ambience signals may be converted from the frequency domain to the time domain, respectively.

Figure 7:
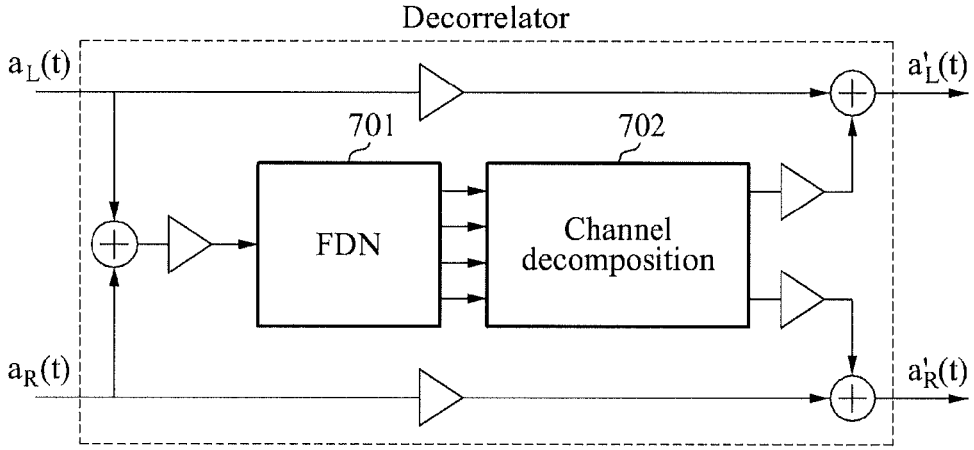
FIG. 7 illustrates a process of decorrelating an ambience signal, according to example embodiments.

FIG. 7 illustrates a process of decorrelating an ambience signal, according to example embodiments.

As aforementioned, the mask applied to extract the ambience signal may be changed by Equations 3 and 4 to reduce the generation of noise. During the change, the primary signal may be mixed into the ambience signal. Although the ambience signal has low similarity between the left signal and the right signal, the similarity may be increased by the partially mixed primary signal.

Thus, the signal processing apparatus may decrease the similarity between the left signal and the right signal of the ambience signal, by post-processing of decorrelating the ambience signal converted from the frequency domain to the time domain.

More specifically, the left signal $a_L(t)$ and the right signal $a_R(t)$ of the ambience signal are summed and input to a module 701. The module 701 includes a feedback delay network. The left signal $a_L(t)$ and the right signal $a_R(t)$ may be output as multichannel signals through the module 701. The output multichannel signals are input to a module 702. Next, through channel decomposition applying a delay, the left signal $a'_L(t)$ and the right signal $a'_R(t)$, the ambience signals with a reduced correlation, may be output.

Figure 8:
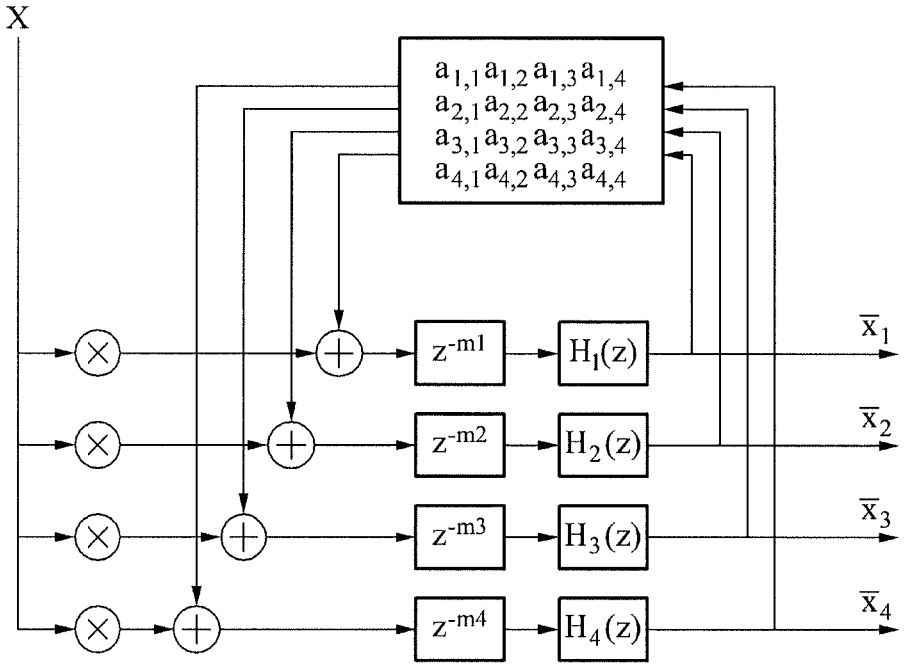
FIG. 8 illustrates a feedback delay network according to example embodiments.

FIG. 8 illustrates a feedback delay network according to example embodiments.

Referring to FIG. 8, the feedback delay network has a generalized serial comb filter structure capable of outputting a signal having an echo density of a high time domain with a relatively small delay.

The input signal of the feedback delay network may be separated into multichannel signals. The respective multichannel signals are multiplied by proper gains and then summed with a feedback value. Next, the multichannel signals are applied with a delay logic Z and passed through a low pass filter $H_n(z)$. The multichannel signals passed through the low pass filter $H_n(z)$ may be fed back by being passed through a matrix A.

The foregoing process may be performed through Equation 6.

$$r(t) = \sum_{i=1}^{N} c_i \cdot q_i(t) \qquad \text{[Equation 6]}$$

$$q_j(t + m_j) = \sum_{i=1}^{N} a_{ij} \cdot q_i(t) + b_j \cdot x(t),\ 1 \le j \le N$$

$$A = \begin{bmatrix} a_{11} & a_{12} & a_{13} & a_{14} \\ a_{21} & a_{22} & a_{23} & a_{24} \\ a_{31} & a_{32} & a_{33} & a_{34} \\ a_{41} & a_{42} & a_{43} & a_{44} \end{bmatrix} = \frac{g}{\sqrt{2}} \begin{bmatrix} 0 & 1 & 1 & 0 \\ -1 & 0 & 0 & -1 \\ 1 & 0 & 0 & -1 \\ 0 & 1 & -1 & 0 \end{bmatrix} (g < 1)$$

A structure of the low pass filter may be expressed by Equation 7.

$$H_p(z) = k_p \cdot \frac{1 - b_p}{1 - b_p z^{-1}} \qquad \text{[Equation 7]}$$

Here, $k_p$ and $b_p$ denote filter coefficients.

Figure 9:
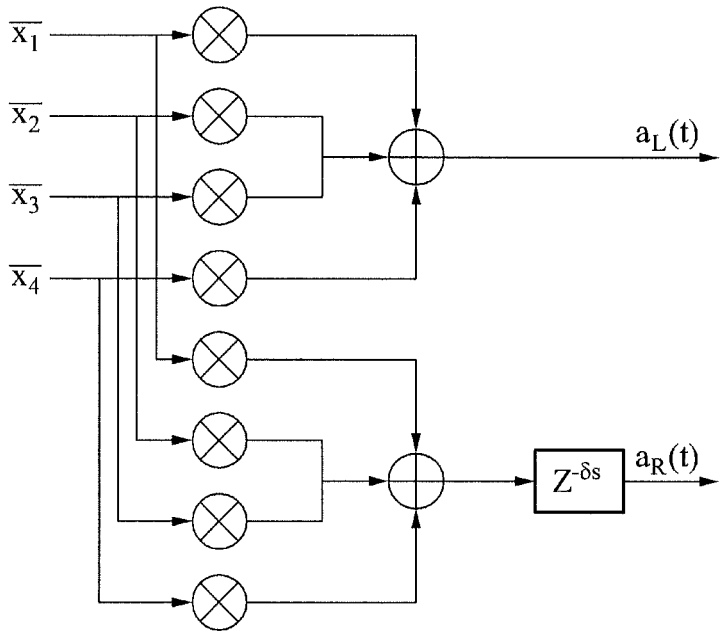
FIG. 9 illustrates a process of performing channel decomposition by applying a delay, according to example embodiments.

FIG. 9 illustrates a process of performing channel decomposition by applying a delay, according to example embodiments.

Channel decomposition is applied to multichannel signals deduced through a feedback delay network. Specifically, the multichannel signals are multiplied by a left coefficient and summed, thereby outputting a left signal $\tilde{\alpha}_L(t)$ which is an ambience signal. Also, the multichannel signals are multiplied by a right coefficient and summed. Next, a delay is applied to the summed signal, thereby outputting a right signal $\tilde{\alpha}_R(t)$ which is a final ambience signal.

Figure 10:
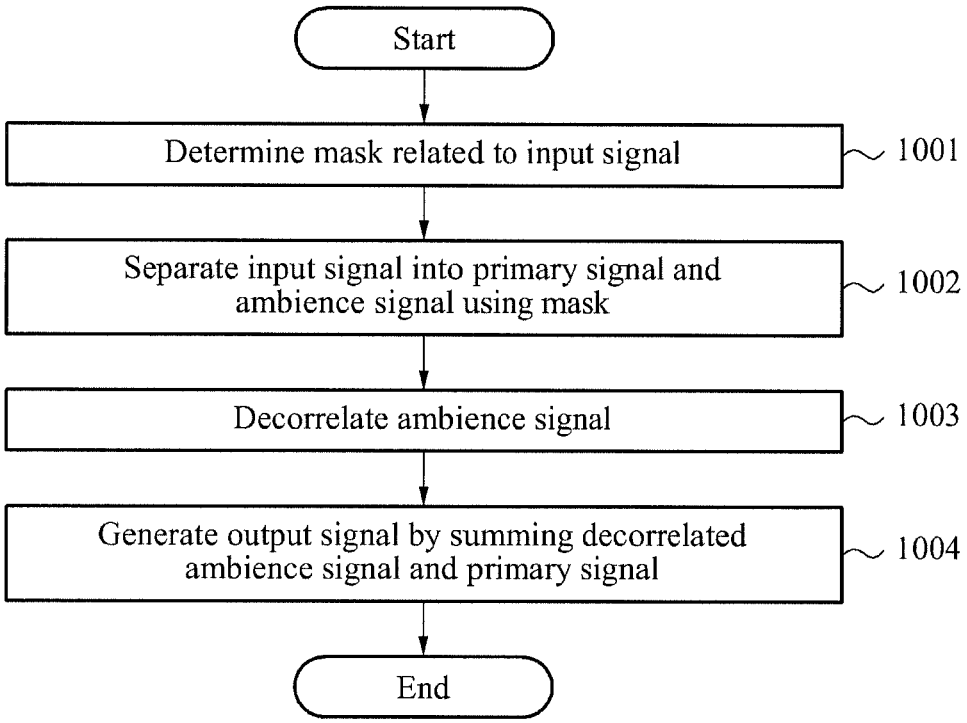
FIG. 10 illustrates a flowchart of a signal processing method according to example embodiments.

FIG. 10 illustrates a flowchart of a signal processing method according to example embodiments.

In operation 1001, a signal processing apparatus may determine a mask related to an ambience of an input signal.

For example, the signal processing apparatus may determine the mask expressed by a level corresponding to the ambience related to a frequency bin of the input signal. Specifically, when the input signal is a stereo signal, the signal processing apparatus may calculate the similarity between a left signal and a right signal based on an influence of the left signal with respect to the right signal and an influence of the right signal with respect to the left signal, and then determine the mask using the calculated similarity.

The signal processing apparatus may apply non-linear mapping to the mask representing the ambience. Additionally, the signal processing apparatus may apply temporal smoothing to the mask representing the ambience to reduce noise caused by a transition of the ambience between frames.

In operation 1002, the signal processing apparatus may separate the input signal into a primary signal and an ambience signal using the mask.

In operation 1003, the signal processing apparatus may decorrelate the ambience signal. For example, the signal processing apparatus may extract a multichannel signal by applying the ambience signal to a feedback delay network.

In operation 1004, the decorrelated ambience signal and the primary signal are summed, thereby outputting an output signal to which a sound effect is applied.

The methods according to the above-described example embodiments may be recorded in non-transitory computer-readable media including program instructions to implement various operations embodied by a computer. The media may also include, alone or in combination with the program instructions, data files, data structures, and the like. The program instructions recorded on the media may be those specially designed and constructed for the purposes of the example embodiments, or they may be of the kind well-known and available to those having skill in the computer software arts. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may also be a distributed network, so that the program instructions are stored and executed in a distributed fashion. The program instructions may be executed by one or more processors. The computer-readable media may also be embodied in at least one application specific integrated circuit (ASIC) or Field Programmable Gate Array (FPGA), which executes (processes like a processor) program instructions. Examples of program instructions include both machine code, such as produced by a compiler, and files containing higher level code that may be executed by the computer using an interpreter. The above-described devices may be configured to act as one or more software modules in order to perform the operations of the above-described embodiments, or vice versa.

Although example embodiments have been shown and described, it would be appreciated by those skilled in the art that changes may be made in these example embodiments without departing from the principles and spirit of the disclosure, the scope of which is defined in the claims and their equivalents.

What is claimed is:

1. A signal processing apparatus comprising:

a processor comprising:

a mask determination unit to determine a mask related to an ambience of an input audio signal;

a signal separation unit to separate the input audio signal into a primary audio signal and an ambience audio signal using the mask;

a decorrelation unit to decorrelate the ambience audio signal; and a signal generation unit to generate an output audio signal to which a sound effect is applied, by summing the decorrelated ambience audio signal and the primary audio signal, wherein, when the input audio signal is a stereo audio signal, the mask determination unit calculates a similarity between a left audio signal and a right audio signal of the stereo audio signal using both an influence of the left audio signal on the right audio signal and an influence of the right audio signal on the left audio signal, and determines the mask using the calculated similarity.

2. The signal processing apparatus of claim 1, wherein the mask determination unit determines the mask expressed by a level corresponding to the ambience related to a frequency bin of the input audio signal.

3. The signal processing apparatus of claim 1, wherein the mask determination unit applies a non-linear mapping to the mask representing the ambience.

4. The signal processing apparatus of claim 1, wherein the mask determination unit applies a temporal smoothing to the mask representing the ambience.

5. The signal processing apparatus of claim 1, wherein the decorrelation unit extracts a multichannel signal by applying the ambience audio signal to a feedback delay network, and performs a channel decomposition by applying a delay to the multichannel signal.

6. The signal processing apparatus of claim 1, wherein the calculated similarity reflects a phase difference between the left audio signal and the right audio signal of the input audio signal and is represented in a real number.

7. A signal processing apparatus comprising:

a processor comprising:

a mask determination unit calculates a similarity between a left audio signal and a right audio signal of the stereo audio signal using both an influence of the left audio signal on the right audio signal and an influence of the right audio signal on the left audio signal, and determines a mask using the calculated similarity;

a signal separation unit to separate a stereo audio signal into a primary audio signal and an ambience audio signal based on the mask;

a decorrelation unit to decorrelate the ambience audio signal; and a signal generation unit to generate an output audio signal to which a sound effect is applied, by summing the decorrelated ambience audio signal and the primary audio signal.

8. The signal processing apparatus of claim 7, wherein the mask determination unit determines the mask using an ambience related to a frequency bin of the stereo audio signal.

9. The signal processing apparatus of claim 7, wherein the decorrelation unit extracts a multichannel signal by applying the ambience audio signal to a feedback delay network, and performs a channel decomposition by applying a delay to the multichannel signal.

10. A signal processing method comprising:

calculating a similarity between a left audio signal and a right audio signal of the stereo audio signal using both an influence of the left audio signal on the right audio signal and an influence of the right audio signal on the left audio signal when the input audio signal is a stereo audio signal;

determining a mask related to an ambience of an input audio signal using the calculated similarity;

separating, by a processor, the input audio signal into a primary audio signal and an ambience audio signal using the mask;

decorrelating the ambience audio signal; and generating an output audio signal to which a sound effect is applied, by summing the decorrelated ambience audio signal and the primary audio signal.

11. The signal processing method of claim 10, wherein the determining of the mask comprises determining the mask expressed by a level corresponding to the ambience related to a frequency bin of the input audio signal.

12. The signal processing method of claim 10, wherein the determining of the mask applies a non-linear mapping to the mask representing the ambience.

13. The signal processing method of claim 10, wherein the determining of the mask comprises applying a temporal smoothing to the mask representing the ambience.

14. The signal processing method of claim 10, wherein the decorrelating of the ambience audio signal comprises:

extracting a multichannel signal by applying the ambience audio signal to a feedback delay network; and performing a channel decomposition by applying a delay to the multichannel signal.

15. A non-transitory computer readable recording medium storing a program to cause a computer to implement the method of claim 10.

16. A signal processing method comprising:

calculating a similarity between a left audio signal and a right audio signal of the stereo audio signal using both an influence of the left audio signal on the right audio signal and an influence of the right audio signal on the left audio signal;

determining a mask using the calculated similarity;

separating, by a processor, a stereo audio signal into a primary audio signal and an ambience audio signal based on the mask;

decorrelating the ambience audio signal; and generating an output audio signal to which a sound effect is applied, by summing the decorrelated ambience audio signal and the primary audio signal.

17. The signal processing method of claim 16, further comprising:

wherein the determining of the mask uses an ambience related to a frequency bin of the stereo audio signal.

18. The signal processing method of claim 16, wherein the decorrelating of the ambience audio signal comprises:

extracting a multichannel signal by applying the ambience audio signal to a feedback delay network; and performing channel decomposition by applying a delay to the multichannel signal.

* * * * *